US012440004B2

(12) United States Patent
Steel

(10) Patent No.: US 12,440,004 B2
(45) Date of Patent: Oct. 14, 2025

(54) CUFF FOR WATCH

(71) Applicant: Steel American Luxury LLC, Winnetka, IL (US)

(72) Inventor: Nicole Steel, Winnetka, IL (US)

(73) Assignee: Steel American Luxury LLC, Winnetka, IL (US)

( * ) Notice: Subject to any disclaimer, the term of this patent is extended or adjusted under 35 U.S.C. 154(b) by 0 days.

(21) Appl. No.: 18/887,929

(22) Filed: Sep. 17, 2024

(65) Prior Publication Data

US 2025/0009080 A1 Jan. 9, 2025

Related U.S. Application Data

(63) Continuation of application No. PCT/US2023/015530, filed on Mar. 17, 2023.

(60) Provisional application No. 63/321,334, filed on Mar. 18, 2022.

(51) Int. Cl.
*A44C 5/12* (2006.01)
*A44C 5/14* (2006.01)

(52) U.S. Cl.
CPC ..... *A44C 5/12* (2013.01); *A44C 5/147* (2013.01)

(58) Field of Classification Search
CPC ..... A44C 5/12; A44C 5/147; A44C 5/2066; A44C 5/0053
USPC ..... 368/268
See application file for complete search history.

(56) References Cited

U.S. PATENT DOCUMENTS 4,561,077 A * 12/1985 Mock ..... A44C 5/14 968/366
5,363,351 A * 11/1994 Carney ..... G04B 37/1493 368/282
6,712,501 B2 3/2004 Kinkio et al.
7,954,680 B2 * 6/2011 Ishihara ..... A44C 5/14 368/282
8,240,011 B2 8/2012 Chevrolet
2010/0302914 A1 * 12/2010 Faucher ..... A44C 5/2076 368/282
2015/0003217 A1 * 1/2015 Leoni ..... A44C 5/14 368/282

(Continued)

FOREIGN PATENT DOCUMENTS

CN 113439914 A * 9/2021 ..... A44C 5/0053
DE 2453679 A1 * 5/1975

(Continued)

OTHER PUBLICATIONS

International Search Report; ISA/US; International Application No. PCT/US2023/015530; Jun. 16, 2023; 2 pages.

(Continued)

*Primary Examiner* — Regis J Betsch
*Assistant Examiner* — Kevin Andrew Johnston
(74) *Attorney, Agent, or Firm* — Taft Stettinius & Hollister LLP

(57) ABSTRACT

A cuff for a watch includes a pair of arcuately shaped arms and a pair of connectors, each detachably connected to a different side of the body of a watch. Each arm is detachably coupled to a different connector. The pair of arms cooperate to define an opening opposite the body of the watch when the arms are coupled to the connectors and the connectors are coupled to the body of the watch. The arms laterally flex outward to allow an object to pass through the opening without breaking.

15 Claims, 11 Drawing Sheets

(56) References Cited

U.S. PATENT DOCUMENTS

| | | | | |
|---|---|---|---|---|
| 2017/0265607 | A1* | 9/2017 | Hatanaka | G04B 37/1486 |
| 2020/0121036 | A1* | 4/2020 | Takasawa | A44C 5/12 |
| 2021/0085041 | A1* | 3/2021 | Schlichtig | G04B 37/22 |

FOREIGN PATENT DOCUMENTS

| | | | | |
|---|---|---|---|---|
| FR | 2721182 | A1 * | 12/1995 | A44C 5/00 |
| GB | 823477 | A | 11/1959 | |
| JP | 5817753 | B2 | 11/2015 | |
| WO | WO-2018139149 | A1 * | 8/2018 | A44C 5/00 |

OTHER PUBLICATIONS

Written Opinion of the International Searching Authority; ISA/US; International Application No. PCT/US2023/015530; Jun. 16, 2023; 9 pages.

* cited by examiner

CUFF FOR WATCH

CROSS REFERENCE TO RELATED APPLICATIONS

This application is a continuation of International Application No. PCT/US2023/015530, filed on Mar. 17, 2023, which claims the benefit of U.S. Provisional Patent Application Ser. No. 63/321,334, filed on Mar. 18, 2022, each of which is hereby incorporated herein by reference in its entirety.

TECHNICAL FIELD

The disclosed technology relates, in general, to wristwatch devices, and more particularly, to a cuff for supporting a user's watch.

BACKGROUND

Wearable electronics are in common use throughout the world. In recent years, smart watches incorporating some or all of the functionality of a smart phone are becoming more prevalent. Many wearable electronics, including conventional watches and smart watches, require a band so they can be worn on a user's wrist. A conventional watch band is made of a flexible material, e.g., rubber or leather, with a latch or other structure that allows two ends of the band to be connected to from a loop around the user's wrist. Alternatively, some watch bands are formed as an elastic, unbroken loop that stretches to allow the user to insert their hand therethrough, and thereafter tightens around the user's wrist.

These conventional watch bands have many drawbacks. First, they are unattractive in appearance, and may look obviously like a piece of equipment strapped to the user's body. Second, because they rely on a material which bends or stretches, this material must be made thin to allow movement, making it relatively weak and subject to fatigue. These watch bands wear out over time, and often develop visible cracks or break altogether, putting the watch in danger of being dropped or lost. Therefore, what is needed is a watch cuff that is more resilient than a conventional watch band and that eliminates potential stress points to enhance the cuff's durability and lifespan.

SUMMARY

The following provides a summary of certain example implementations of the disclosed inventive subject matter. This summary is not an extensive overview and is not intended to identify key or critical aspects or elements of the disclosed inventive subject matter or to delineate its scope. However, it is to be understood that the use of indefinite articles in the language used to describe and claim the disclosed inventive subject matter is not intended in any way to limit the described inventive subject matter.

One embodiment provides a watch cuff, including a first connector coupled to a first side of a body of a watch; a first arm having an arcuate profile and formed from a rigid or semi-rigid material, the first arm comprising a first attachment point configured to detachably couple the first arm to the first connector; and a second arm having an arcuate profile and formed from the rigid or semi-rigid material, the second arm comprising a second attachment point configured to detachably couple the second arm to the second connector, wherein the first and second arms cooperate to define an opening opposite the body of the watch when the first and second arms are coupled to the first and second connectors, and the first and second connectors are coupled to the first and second sides of the body of the watch, wherein the first and second arms are configured to laterally flex outward to allow an object to pass through the opening without breaking.

In certain embodiments, the first and second arms return to a pre-flexed shape once the object passes through the opening, securing the watch cuff to the object. In certain embodiments, each of the first arm and the second arm comprises a top surface, a bottom surface, and a connecting surface extending between the top surface and the bottom surface, the connecting surface of each of the first and second arms defining the first and second attachment points; the connecting surface of the first arm defining a first cavity and a second cavity, each extending inwardly from the connecting surface; the connecting surface of the second arm defining a third cavity and a fourth cavity, each extending inwardly from the connecting surface; the first connector comprises a first front connector surface and a first rear connector surface, the first front connector surface configured to couple to the first side of the body of the watch and the first rear connector surface configured to couple to the first arm, wherein the first rear connector surface comprises first and second prongs extending therefrom, the first and second prongs have a shape that corresponds with a shape of the first cavity and the second cavity of the first arm; and the second connector comprises a second front connector surface and a second rear connector surface, the second front connector surface configured to couple to the second side of the body of the watch and the second rear connector surface configured to couple to the second arm, wherein the second rear connector surface comprises third and fourth prongs extending therefrom, the third and fourth prongs have a shape that corresponds with a shape of the third cavity and the fourth cavity of the second arm. In certain embodiments, each of the first arm and the second arm comprises a top surface, a bottom surface, and a connecting surface extending between the top surface and the bottom surface, the connecting surface of each of the first and second arms defining the first and second attachment points; the connecting surface of the first arm comprises a first prong and a second prong, each extending from the connecting surface; the connecting surface of the second arm comprises a third prong and a fourth prong, each extending from the connecting surface; the first connector comprises a first front connector surface and a first rear connector surface, the first front connector surface configured to couple to the first side of the body of the watch and the first rear connector surface configured to couple to the first arm, wherein the first rear connector surface defining first and second cavities extending inwardly therefrom, the first and second cavities have a shape that corresponds with a shape of the first prong and the second prong of the first arm; and the second connector comprises a second front connector surface and a second rear connector surface, the second front connector surface configured to couple to the second side of the body of the watch and the second rear connector surface configured to couple to the second arm, wherein the first rear connector surface defining first and second cavities extending inwardly therefrom, the first and second cavities have a shape that corresponds with a shape of the third prong and the fourth prong of the second arm. In certain embodiments, the first and second connectors are integrally formed to the respective first and second arms such that the first connector and the first arm are one integrated piece and the second connector and the second arm are one integrated piece. The first and second arms comprise one or more of thermoplastics, polycarbonates, nylon, elastomeric materials, carbon fiber, steel, precious metals, and semi-precious metals. Each of the first and second removable shells comprise one or more of fabric, plastic, metal, and leather.

Another embodiment provides a watch cuff, comprising a first connector having a first connecting surface, a second connecting surface opposite the first connecting surface, and a prong extending from the first connecting surface, the second connecting surface detachably coupled to a watch; a second connector having a third connecting surface, a fourth connecting surface opposite the third connecting surface, and a prong extending from the third connecting surface, the fourth connecting surface detachably coupled to the watch opposite the second connecting surface of the first connector; a first arm having an arcuate profile, the first arm comprising a first attachment surface defining a cavity extending inwardly therefrom, the cavity having a shape and position that corresponds with a shape and position of the prong extending from the first connecting surface, wherein the cavity of the first attachment surface and the prong extending from the first connecting surface cooperate to couple the first connector to the first arm; and a second arm having an arcuate profile, the second arm comprising a second attachment surface defining a cavity extending inwardly therefrom, the cavity having a shape and position that corresponds with a shape and position of the prong extending from the third connecting surface, wherein the cavity of the second attachment surface and the prong extending from the third connecting surface cooperate to couple the second connector to the second arm, wherein the first and second arms cooperate to define an opening opposite the watch when the at least first and second attachment surfaces are coupled to the first and second connectors, and the first and second connectors are coupled to the watch, wherein the first and second arms are configured to laterally flex outward from an initial position to a flexed position to allow an object to pass through the opening.

In certain embodiments, the prong of the first connector is a first prong and the first connector further comprises a second prong extending from the first connecting surface; the prong of the second connector is a third prong and the second connector further comprises a fourth prong extending from the third connecting surface; the cavity defined by the first attachment surface is a first cavity and the first attachment surface further defining a second cavity extending inwardly therefrom, the second cavity having a shape and position that corresponds with a shape and position of the second prong extending from the first connecting surface; the cavity defined by the second attachment surface is a third cavity and the second attachment surface further defining a fourth cavity extending inwardly therefrom, the fourth cavity having a shape and position that corresponds with a shape and position of the fourth prong extending from the third connecting surface; the first and second cavities of the first attachment surface and the first and second prongs extending from the first connecting surface cooperate to couple the first connector to the first arm; and the third and fourth cavities of the second attachment surface and the third and fourth prongs extending from the third connecting surface cooperate to couple the second connector to the second arm. In certain embodiments, the cavity of the first attachment surface extends inwardly a distance between about 0.05 mm and about 4.0 mm measured from the first attachment surface; and wherein the cavity of the second attachment surface extends inwardly a distance between about 0.05 mm and about 4.0 mm measured from the second attachment surface. The first and second arms return to a pre-flexed shape in the initial position once the object passes through the opening to secure the watch to the object. In certain embodiments, each of the first and second arms further define an aperture that extends through a width of the first and second arms; the prong of the first connector and the prong of the second connector each define a hole that coaxially aligns with the respective aperture defined by the first and second arms; the watch cuff further comprise a first lock and a second lock, the first lock configured to engage the aperture defined by the first arm and the hole defined by the prong of the first connector to secure the first connector to the first arm, and the second lock configured to engage the aperture defined by the second arm and the hole defined by the prong of the second connector to secure the second connector to the second arm. The first and second locks each comprise a screw or pin. The first and second arms comprise one or more of thermoplastics, polycarbonates, nylon, elastomeric materials, carbon fiber, steel, precious metals, and semi-precious metals. In certain embodiments, the watch cuff further comprises a first removable shell configured to encase the first arm and a second removable shell configured to encase the second arm. Each of the first and second removable shells comprise one or more of fabric, plastic, metal, and leather.

Still another embodiment provides a watch, comprising a watch body having a first watch connecting interface, and a second watch connecting interface opposite the first watch connecting interface; a first connector coupled to the first watch connecting interface of the watch, the first connector comprises four prongs on a first connecting surface; a second connector coupled to the second watch connecting interface of the watch, the second connector comprises four prongs on a second connecting surface; a first arm having an arcuate profile and formed from a rigid or semi-rigid material, the first arm comprising a first attachment surface defining cavities extending inwardly therefrom, the cavities having a shape and position that corresponds with a shape and position of the prongs extending from the first connecting surface, wherein the cavities of the first attachment surface and the prongs extending from the first connecting surface cooperate to couple the first connector to the first arm; a second arm having an arcuate profile and formed from the rigid or semi-rigid material, the second arm comprising a second attachment surface defining cavities extending inwardly therefrom, the cavities having a shape and position that corresponds with a shape and position of the prongs extending from the second connecting surface, wherein the cavities of the second attachment surface and the prongs extending from the second connecting surface cooperate to couple the second connector to the second arm; wherein the first and second arms cooperate to define a cuff having an opening opposite the watch body when the first and second attachment surfaces are coupled to the first and second connectors and the first and second connectors are coupled to the watch body, wherein the first and second arms are configured to laterally flex outward from an initial position to a flexed position to allow an object to pass through the opening.

In certain embodiments, the cavities of the first attachment surface extend inwardly a distance between about 0.05 mm and about 4.0 mm measured from the first attachment surface; and wherein the cavities of the second attachment surface extend inwardly a distance between about 0.05 mm and about 4.0 mm measured from the second attachment surface. The first and second arms return to a pre-flexed shape in the initial position once the object passes through the opening to secure the watch to the object.

BRIEF DESCRIPTION OF THE DRAWINGS

The accompanying drawings, which are incorporated into and form a part of the specification, schematically illustrate one or more example implementations of the disclosed technology and, together with the general description given above and detailed description given below, serve to explain the principles of the disclosed subject matter, and wherein.

DETAILED DESCRIPTION

Figure 1:
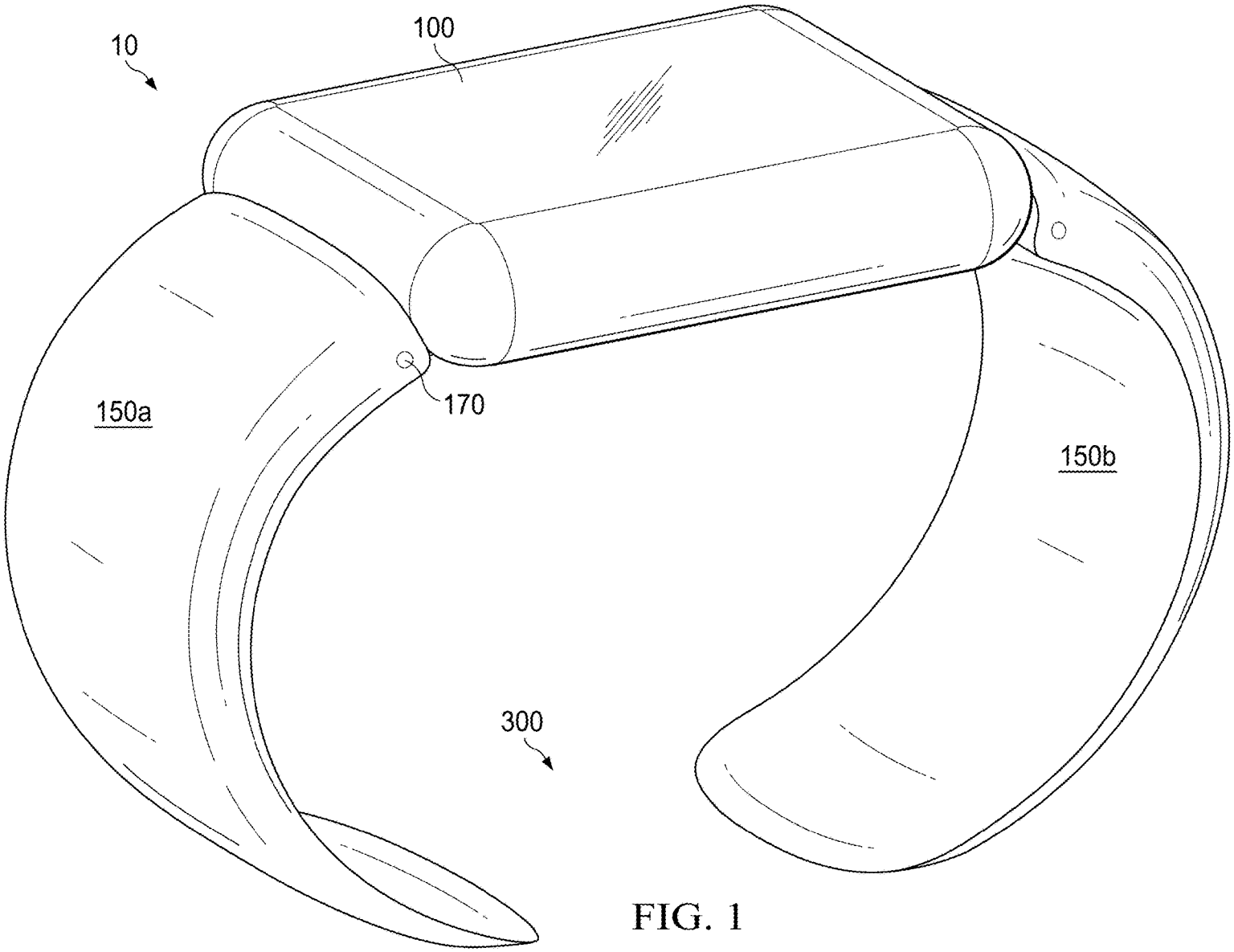
FIG. 1 depicts an example implementation of the disclosed cuff shown in an assembled configuration, wherein the cuff includes two arms with attachment points, two connectors, two pins, an external watch, and an opening formed between the two arms opposite of the watch.
Figure 2:
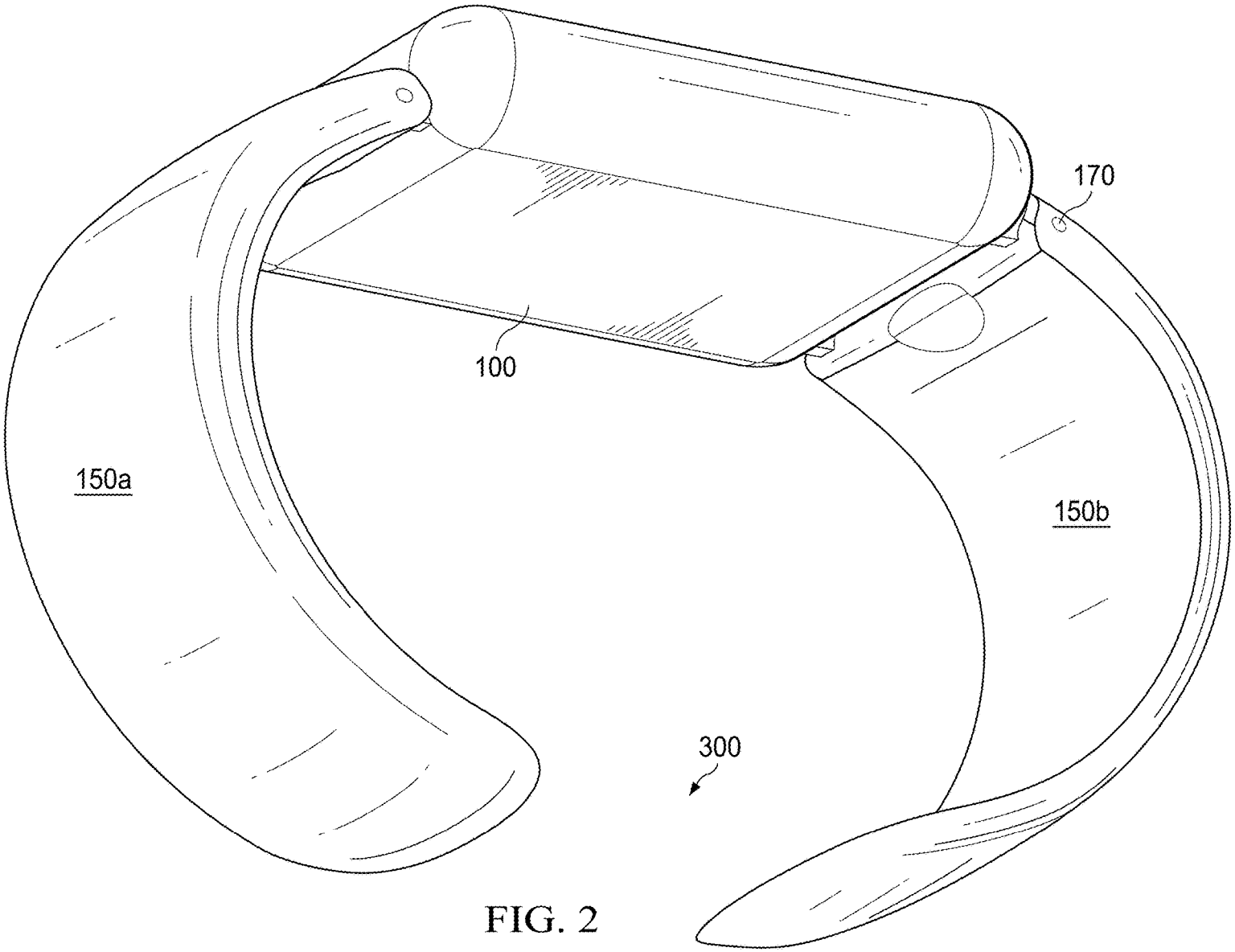
FIG. 2 is a bottom perspective view of the cuff of FIG. 1.
Figure 3:
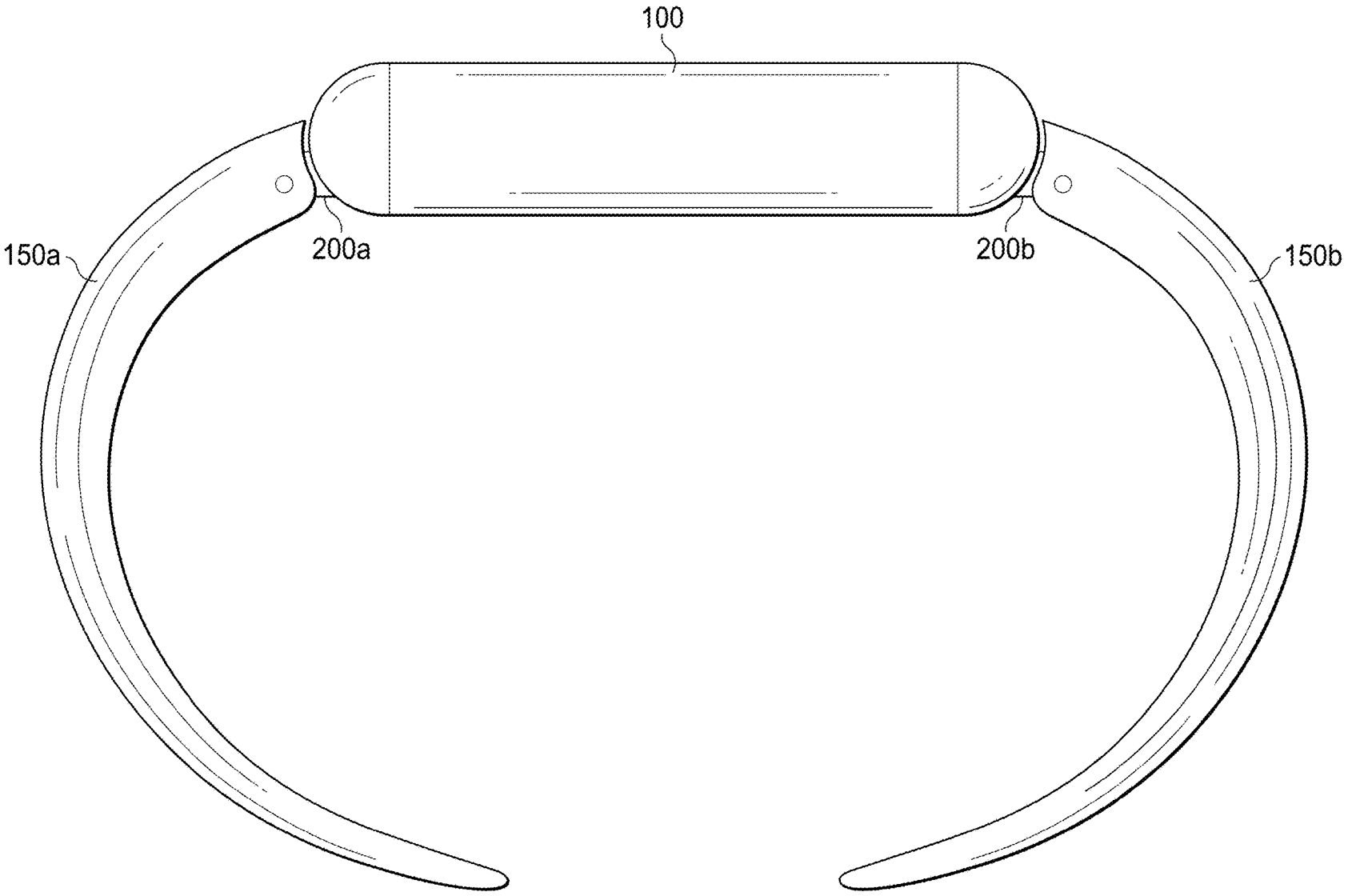
FIG. 3 is a side view of the cuff of FIG. 1.

Certain embodiments are hereinafter described in detail in connection with the views and examples of FIGS. 1-11, wherein like numbers indicate the same or corresponding elements throughout the views.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

The examples discussed herein are examples only and are provided to assist in the explanation of the apparatuses, devices, systems, and methods described herein. None of the features or components shown in the drawings or discussed below should be taken as mandatory for any specific implementation of any of these the apparatuses, devices, systems, or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, it should be understood that unless otherwise specified or required by context, any explicit or implicit ordering of steps performed in the execution of a method does not imply that those steps must be performed in the order presented but instead may be performed in a different order or in parallel.

A cuff 10 according to one example implementation may be referred to as SmrtKuff™. An example implementation of the disclosed cuff 10 is illustrated in FIGS. 1-5. As illustrated therein, the cuff 10 includes two arms 150*a* and 150*b* and two connectors 200 (i.e., connectors 200*a*, 200*b*). Each of the connectors 200*a*, 200*b* is associated with a different arm 150*a*, 150*b*. In some embodiments, such as the one shown in FIGS. 1-5, the cuff 10 is configured to be detachably connected to a watch 100. Watch 100 may be any type of portable electronic device or object configured to be worn on a user's wrist, including, for example, a smartwatch, a conventional watch (e.g., analog, digital, etc.), a fitness tracker, or sensor. It should be appreciated that cuff 10, and accordingly watch 100, may be worn elsewhere on a user's body, including, but not limited to, a user's arm, leg, ankle, head, and torso. The overall shapes and sizes of the cuff 10 and watch 100 illustrated in the drawings are provided as examples. It will be understood that the specific sizes and shapes of the arms 150, broken loop of the cuff 10, watch 100, and other features may form a variety of ornamental or visually appealing designs, which can vary based on the desired aesthetic.

Figure 5:
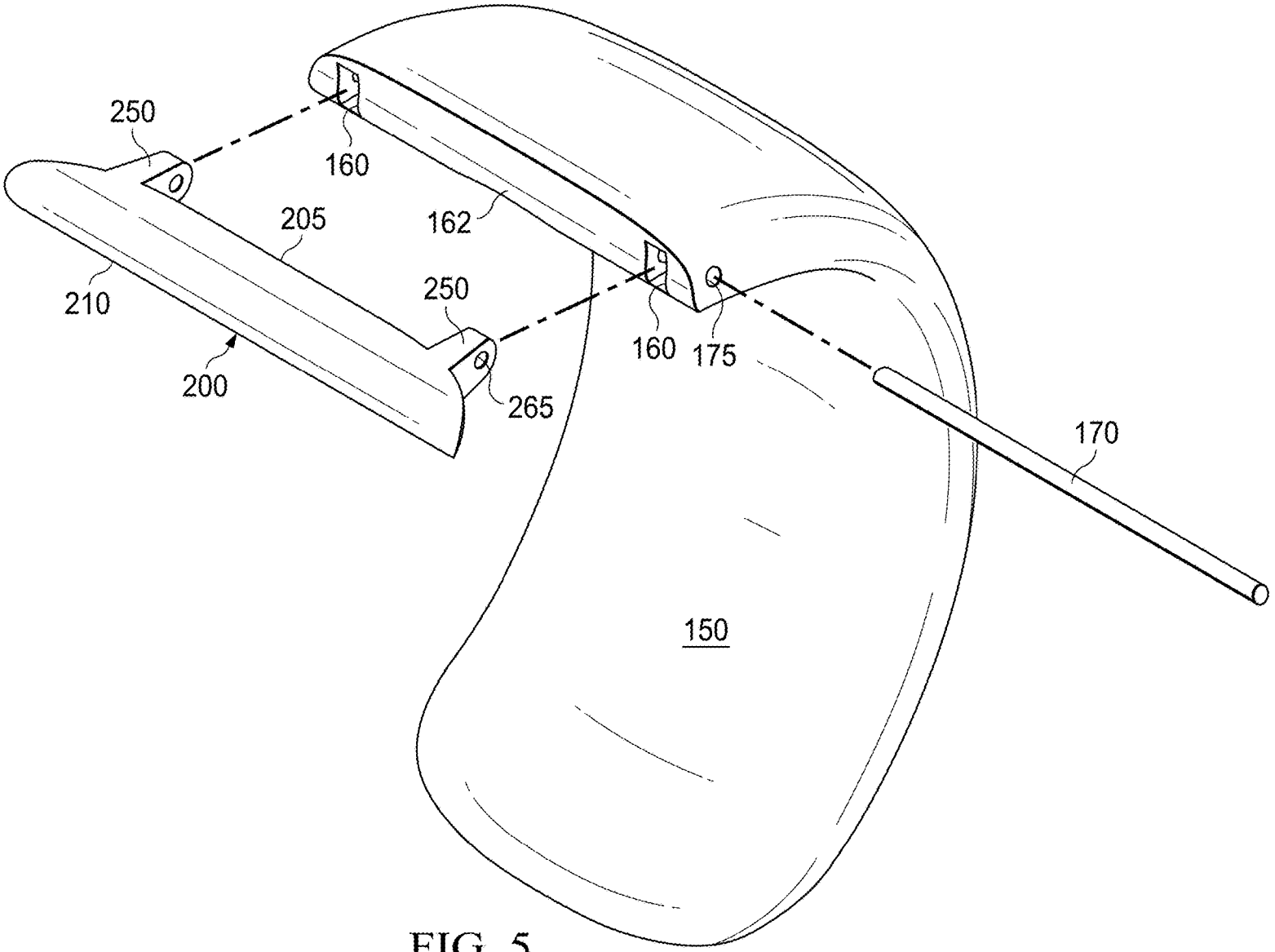
FIG. 5 depicts one arm with attachment points, one connector, and one pin of FIG. 1 shown in an exploded configuration.

As illustratively shown in FIG. 5, each connector 200 includes a front connector surface 210 that can be detachably coupled to watch 100 and a rear connector surface 205 that can be detachably coupled to a different arm 150*a*, 150*b*. One or more studs or prongs 250 extend from the rear connector surface 205 of each connector 200.

The arms 150 may be formed from a rigid or semi-rigid material, such that the material can be formed into a free-standing structure that will maintain its shape without external support. Such a material may still deform elastically, i.e., may be temporarily deformed by an external force, and resume its original shape when the external force is removed. The arms 150 can be made from a material with a high elastic limit, and may be deformed elastically by a non-negligible amount without being permanently reshaped or damaged. The arms 150 can also be made of a material with low brittleness, i.e., less susceptible to damage from sudden impacts, for example from being bumped or dropped. According to example implementations of the present general inventive concept, the arms 150 may also be formed from plastic including thermoplastics such as acrylonitrile butadiene styrene ("ABS") and polycarbonates, as well as nylon, carbon fiber, steel, precious or semi-precious metal, or a combination of such materials. It will be understood that this list is for example purposes only, and is not intended to be limiting.

Further, the arms 150 may be formed by any method suitable to the material they are made out of. For example, if the arms 150 are made of a plastic such as ABS, they may be formed by 3D printing or injection molding. In a 3D printing process, the arms 150 can be formed by depositing thin layers of the material on top of one another, forming the final shape one layer at a time. In an injection molding process, a custom-made injection mold is prepared, into which molten or liquid material (e.g., ABS) is injected and cured into the final shape of the arms 150.

The arms 150*a* and 150*b* may cooperate to form a broken loop, such that when a watch 100 is connected to the arms 150, there is an opening 300 defined opposite the watch 100. The arms 150 may flex elastically to admit a user's wrist through the opening 300, and return back to their original shape once the user's wrist has passed through. The arms 150 are formed such that the cuff 10 may be worn on either side of the user's wrist, i.e., such that the opening 300 is facing towards or away from the user's body.

The arms 150 may be any size suited to the particular embodiment of the present general inventive concept, e.g., according to the intended user. According to exemplary embodiments of the present general inventive concept, the arms 150 may have a thickness of about 1 mm to about 25 mm and a width of about 5 mm to about 50 mm.

The arms 150 may be structurally identical, i.e., the same size and shape, and may form a symmetrical shape as a result. For example, as illustratively shown in FIGS. 1-5, the arms 150 can each have an arcuate or curved profile. In other example implementations, the arms 150*a*, 150*b* may be different sizes and shapes, but still define the opening 300 to admit a user's wrist or other body part.

Figure 4:
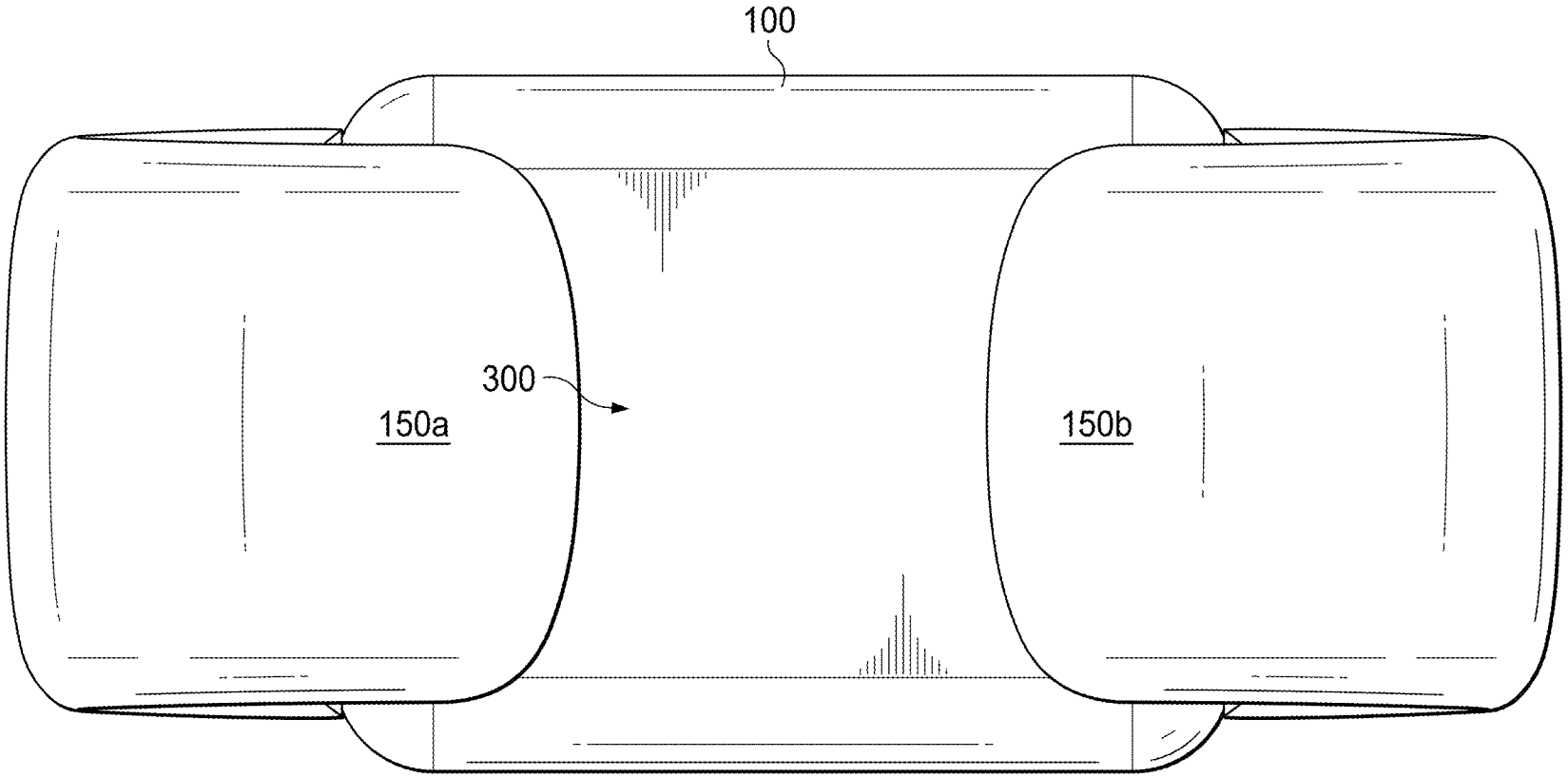
FIG. 4 is a bottom view of the cuff of FIG. 1.

FIG. 4 is a bottom view of the cuff 10, illustrating the opening 300. The size of the opening 300 may vary based on the average size and shape of the intended user's wrist (or other body part), and/or based on the desired aesthetic design of the cuff 10. According to one example implementation, the opening 300 may be between about 1 mm to about 50 mm in size. According to another exemplary embodiment, the opening 300 is between about 1 mm to about 20 mm in size. However, these are only examples, and it will be understood that the size of the opening 300 can vary based on the intended application.

The connectors 200 (e.g., connectors 200*a*, 200*b*) may be any apparatus or structure suitable to connect the watch 100 to the cuff 10. The connectors 200 may be tailored to a specific type of watch 100, for example the Apple™ Watch, a Samsung™ smart watch, or other personal electronics designed to be worn on the wrist or other portion of a user's body, including fitness trackers such as a FitBit™. The dimensions of the arms 150 may be selected based on the dimensions of the intended connector 200. As a non-limiting example, if the connector 200 has a width of 25 mm, the arms 150 may be manufactured such that at least a portion of each arm 150 is 25 mm wide. Of course, the dimensions of the connector 200 can also be selected based on the dimensions of the arms 150. For example, if each arm 150 has a width of 20 mm, then a connector 200 with at least a portion that is 20 mm wide can be manufactured.

With reference to FIG. 5, each arm 150 may include an attachment point 160 on an attachment surface 162, to which the connector 200 may be attached. The attachment point 160 may be a protrusion, cavity, or other structure suitable to accept the connector 200 or a portion thereof, such as, for example, the one or more studs or prongs 250. In some embodiments, such as the one illustratively shown in FIG. 5, the attachment point 160 comprises a pair of holes or cavities that extend inwardly from the attachment surface 162. In such embodiments, the one or more studs or prongs 250 of a connector 200 can be inserted into the holes or cavities 160 of a corresponding arm 150, thereby coupling the connector 200 to the arm 150. It will be understood that the attachment points 160 may be different sizes or shapes from those illustrated, to accommodate different connectors 200 and allow space for the connectors 200 to connect to the watch 100.

Different connectors 200 may require different attachment points 160 to securely attach to the cuff 10. For example, some connectors 200 may require holes or cavities 160 on the attachment surface 162 of each arm 150 to accept the studs or prongs 250 that extend from the rear connector surface 205 of the connectors 200, as illustrated in FIG. 5. These holes or cavities 160 (attachment points 160) formed on the attachment surface 162 of the arms 150 may be about 0.05 mm to about 4 mm in depth from the attachment surface 162. The depth of the holes or cavities allows the studs or prongs 250 to rotate, minimally, within the attachment points 160. Because the prongs 250 are free to rotate minimally within the attachment points 160 and are not rigidly fastened, lateral breakage of the cuff 10 is prevented when the arms 150 are separated for a user's wrist. In some embodiments, such as the one illustratively shown in FIG. 5, the connectors 200 can be coupled to the arms 150 with one or more screws or pins 170. According to an exemplary embodiment, the connector 200 may be attached to the attachment point 160 with an adhesive. In another embodiment, each connector 200 can define a channel extending transversely through the width of the connector 200 proximate to the front connector surface 210. In such embodiments, a fixed pin, a spring-loaded pin, a screw, or any other suitable mechanical structure can be inserted through the channel and into correspondingly configured holes or channels on the body of the watch 100.

As discussed herein, the connectors 200 can be coupled to the arm 150 with a pin 170. In some embodiments, such as the one shown in FIG. 5, a channel 265 is formed that extends through the width of each stud or prong 250 of each connector 200. Another channel 175 is formed in the side of the arm 150 that extends through the width of the arm 150. In such embodiments, the channels 165 of the studs or prongs 250 of each connector 200 coaxially align with the channel 175 of a corresponding arm 150 when the studs or prongs 250 of each connector 200 are inserted into the holes or cavities 160 (attachment points 160) of the corresponding arm 150. The pin 170 can be inserted through the channels 175, 265 to couple the connector 200 to the arm 150. According to example implementations of the present general inventive concept, the pin 170 may have a thickness between about 0.02 mm and about 2 mm, and may have a length equal to or less than the width of the arms 150. In exemplary embodiments including the pin 170, such pin 170 can be formed of a high-strength material such as steel or a similar metal. According to exemplary embodiments of the present general inventive concept, the pin 170 may be a single component which extends partially or completely across the width of the arm 150. According to other exemplary embodiments, the pin 170 may be multiple components, e.g., two pieces which are inserted on either side of the arm 150 and extend only partially across the width of the arm 150.

Exemplary embodiments of the present general inventive concept may use a combination of methods, e.g., glue, screws, and/or one or more pins 170, to attach each connector 200 to a corresponding attachment point 160. The attachment points 160 may be made general-purpose, i.e., formed to accommodate multiple types of connectors 200, for example by including a plurality of different cavities, protrusions, etc. Alternatively, each attachment point 160 may be formed to accommodate a specific type of connector 200.

Figure 6:
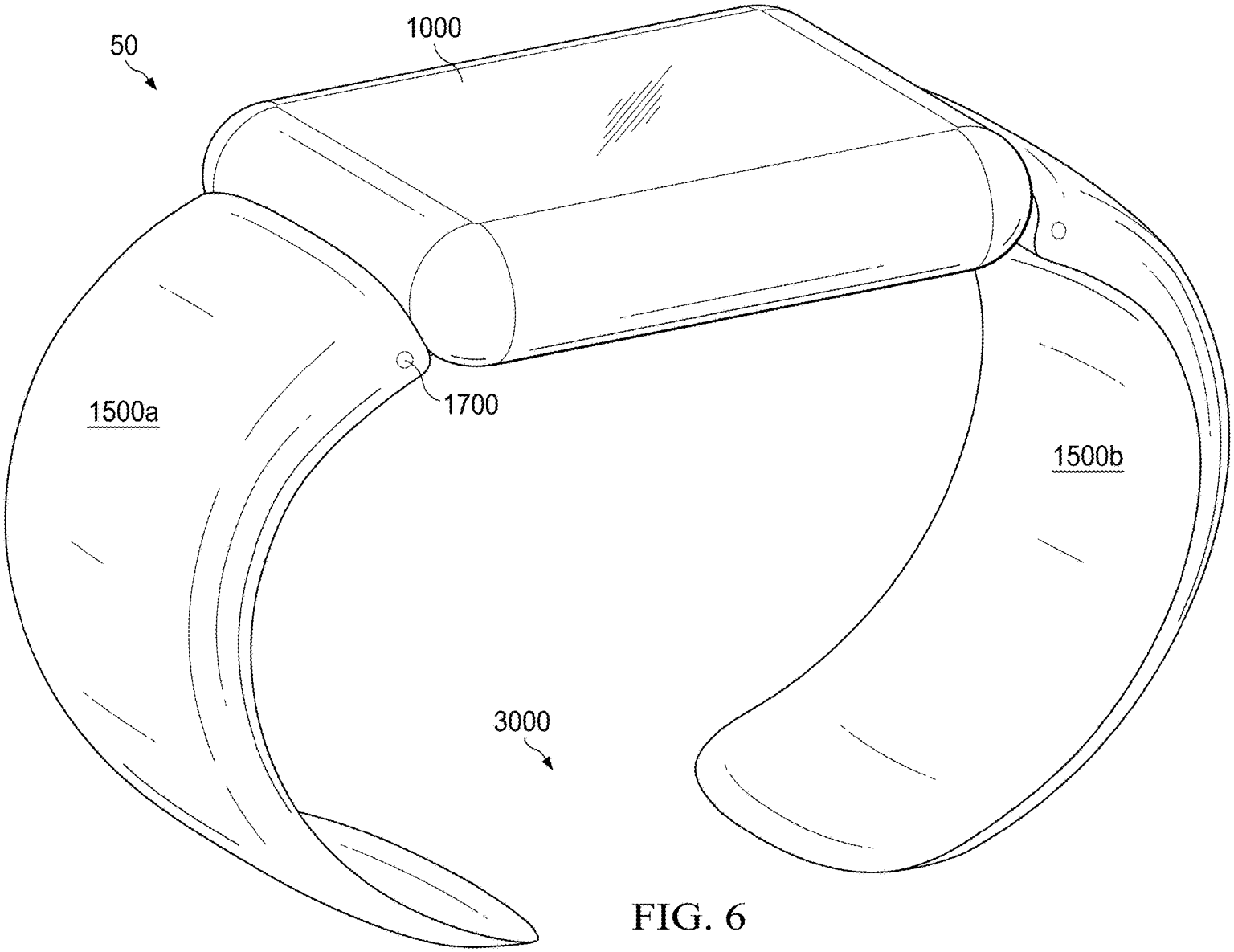
FIG. 6 depicts another example implementation of the disclosed cuff shown in an assembled configuration, wherein the cuff includes two arms with attachment points, two connectors, two pins, an external watch, and an opening formed between the two arms opposite of the watch.
Figure 7:
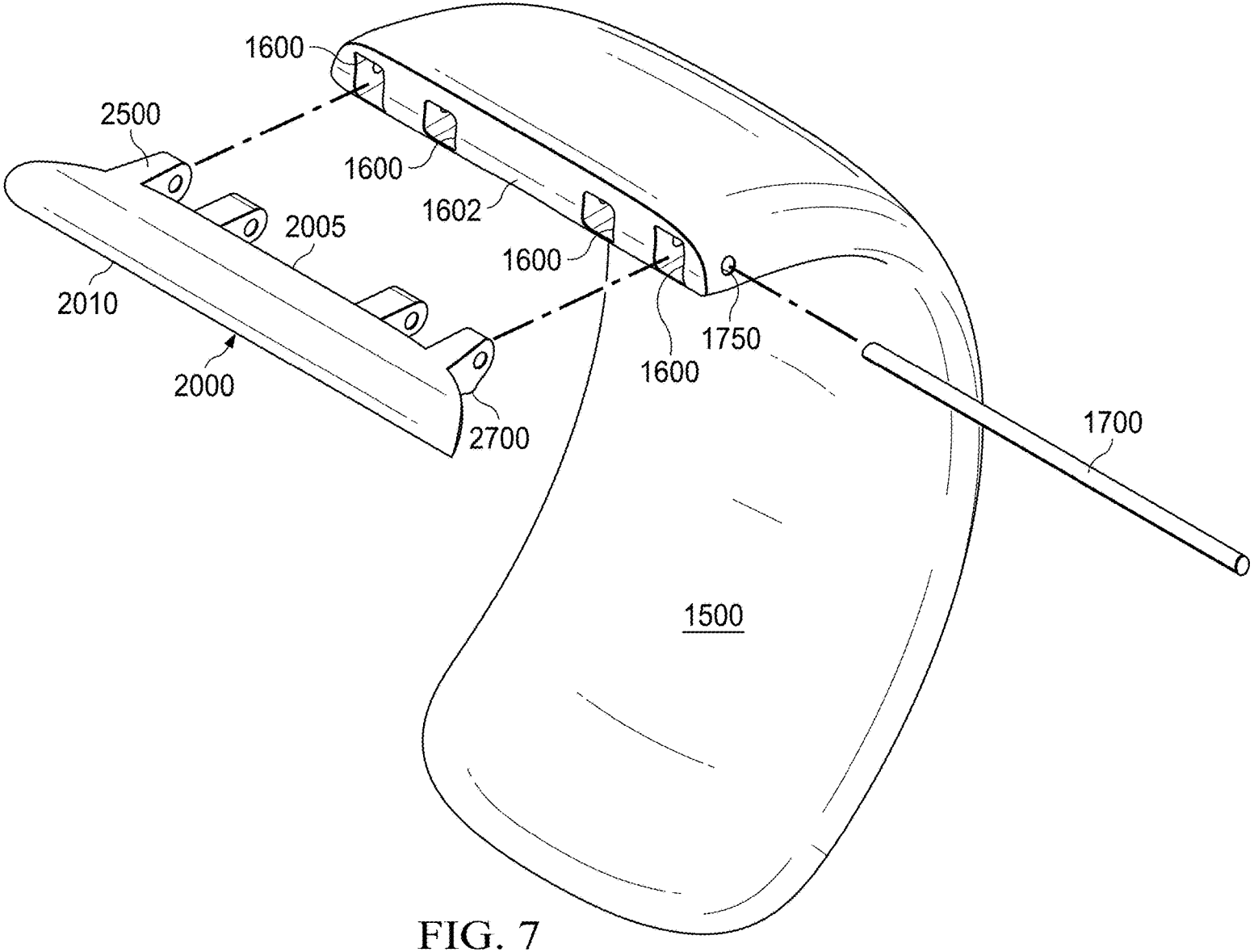
FIG. 7 depicts one arm with attachment points, one connector, and one pin of FIG. 6 shown in an exploded configuration.

A cuff 50 according to another example implementation is illustrated in FIGS. 6 and 7. As illustrated therein, cuff 50 may include two arms 1500*a* and 1500*b*. The cuff 50 is configured to be connected to a watch 1000. Watch 1000 may be any type of portable electronic device or object configured to be worn on a user's wrist, including, for example, a smartwatch, a conventional watch (e.g., analog, digital, etc.), a fitness tracker, or sensor. It should be appreciated that cuff 50, and accordingly watch 1000, may be worn elsewhere on a user's body, including, but not limited to, a user's arm, leg, ankle, head, and torso. The overall shapes and sizes of the cuff 50 and watch 1000 illustrated in the drawings are provided as examples. It will be understood that the specific sizes and shapes of the arms 1500*a*, 1500*b*, broken loop of the cuff 50, watch 1000, and other features may form a variety of ornamental or visually appealing designs, which can vary based on the desired aesthetic.

As illustratively shown in FIG. 7, each connector 2000 may include a front connector surface 2010 that is detachably coupled to watch 1000 and a rear connector surface 2005 that can be detachably coupled to a different arm 1500*a*, 1500*b*. In the embodiment shown in FIG. 7, four studs or prongs 2500 extend from the rear connector surface 2005 of each connector 2000.

The arms 1500 may be formed from a rigid or semi-rigid material, such that the material can be formed into a free-standing structure that will maintain its shape without external support. Such a material may still deform elastically, i.e., may be temporarily deformed by an external force, and resume its original shape when the external force is removed. The arms 1500 can be made from a material with a high elastic limit, and may be deformed elastically by a non-negligible amount without being permanently reshaped or damaged. The arms 1500 can also be made of a material with low brittleness, i.e., less susceptible to damage from sudden impacts, for example from being bumped or dropped. According to example implementations of the present general inventive concept, the arms 1500 may be formed from plastic including thermoplastics such as ABS and polycarbonates, as well as nylon, carbon fiber, steel, precious or semi-precious metal, or a combination of such materials. It will be understood that this list is for example purposes only, and is not intended to be limiting.

The arms 1500 may be formed by any method suitable to the material they are made out of. For example, if the arms 1500 are made of a plastic such as ABS, they may be formed by 3D printing or injection molding. In a 3D printing process, the arms 1500 can be formed by depositing thin layers of the material on top of one another, forming the final shape one layer at a time. In an injection molding process, a custom-made injection mold is prepared, into which molten or liquid material (e.g., ABS) is injected and cured into the final shape of the arms 1500.

The arms 1500*a* and 1500*b* may cooperate to form a broken loop, such that when a watch 1000 is connected to the arms 1500 there is an opening 3000 defined opposite the watch 1000. The arms 150 may flex elastically to admit a user's wrist through the opening 3000, and return back to their original shape once the user's wrist has passed through. The arms 1500 can be formed such that the cuff 10 may be worn on either side of the user's wrist, i.e., such that the opening 3000 is facing towards or away from the user's body.

The arms 1500 may be any size suited to the particular embodiment of the present general inventive concept, e.g., according to the intended user. According to exemplary embodiments of the present general inventive concept, the arms 1500 may have a thickness of about 1 mm to about 25 mm and a width of about 5 mm to about 50 mm.

The arms 1500 may be structurally identical, i.e., the same size and shape, and may form a symmetrical shape as a result. For example, as illustratively shown in FIG. 6, the arms 1500*a*, 1500*b* can each have an arcuate or curved profile. In other example implementations, the arms 1500*a*, 1500*b* may be different sizes and shapes, but still define the opening 3000 to admit a user's wrist or other body part.

The size of the opening 3000 may vary based on the average size and shape of the intended user's wrist (or other body part), and/or based on the desired aesthetic design of the cuff 50. According to example implementations of the present general inventive concept, the opening 3000 may be between about 1 mm to about 50 mm in size. According to an exemplary embodiment, the opening 3000 is between about 1 mm to about 20 mm in size. However, these are only examples, and it will be understood that the size of the opening 3000 can vary based on the intended application.

The connectors 2000 may be any apparatus or structure suitable to connect the watch 1000 to the cuff 50. The connectors 2000 may be tailored to a specific type of watch 1000, for example the Apple™ Watch, a Samsung™ smart watch, or other personal electronics designed to be worn on the wrist or other portion of a user's body, including fitness trackers such as a FitBit™. The dimensions of the arms 1500*a*, 1500*b* may be selected based on the dimensions of the intended connector 2000. As a non-limiting example, if the connector 2000 has a width of 25 mm, the arms 1500*a*, 1500*b* may be manufactured such that at least a portion of each arm 1500*a*, 1500*b* is 25 mm wide. Of course, the dimensions of the connector 2000 can also be selected based on the dimensions of the arms 1500*a*, 1500*b*. For example, if each arm 1500*a*, 1500*b* has a width of 20 mm, then a connector 2000 with at least a portion that is 20 mm wide can be manufactured.

With reference to FIG. 7, each arm 1500 may include four attachment points 1600 on an attachment surface 1602, to which the connector 2000 may be attached. The attachment points 1600 may be a protrusion, cavity, or other structure suitable to accept the connector 2000 or a portion thereof, such as, for example, the four studs or prongs 2500. In some embodiments, such as the one illustratively shown in FIG. 7, the attachment points 1600 comprises four holes or cavities that extend inwardly from the attachment surface 1602. In such embodiments, the four studs or prongs 2500 of a connector 2000 can be inserted into the four correspondingly configured holes or cavities 1600 of a corresponding arm 1500, thereby coupling the connector 2000 to the arm 1500. It will be understood that the attachment points 1600 may be different sizes or shapes from those illustrated, to accommodate different connectors 200 and allow space for the connectors 2000 to connect to the watch 1000.

Figure 8:
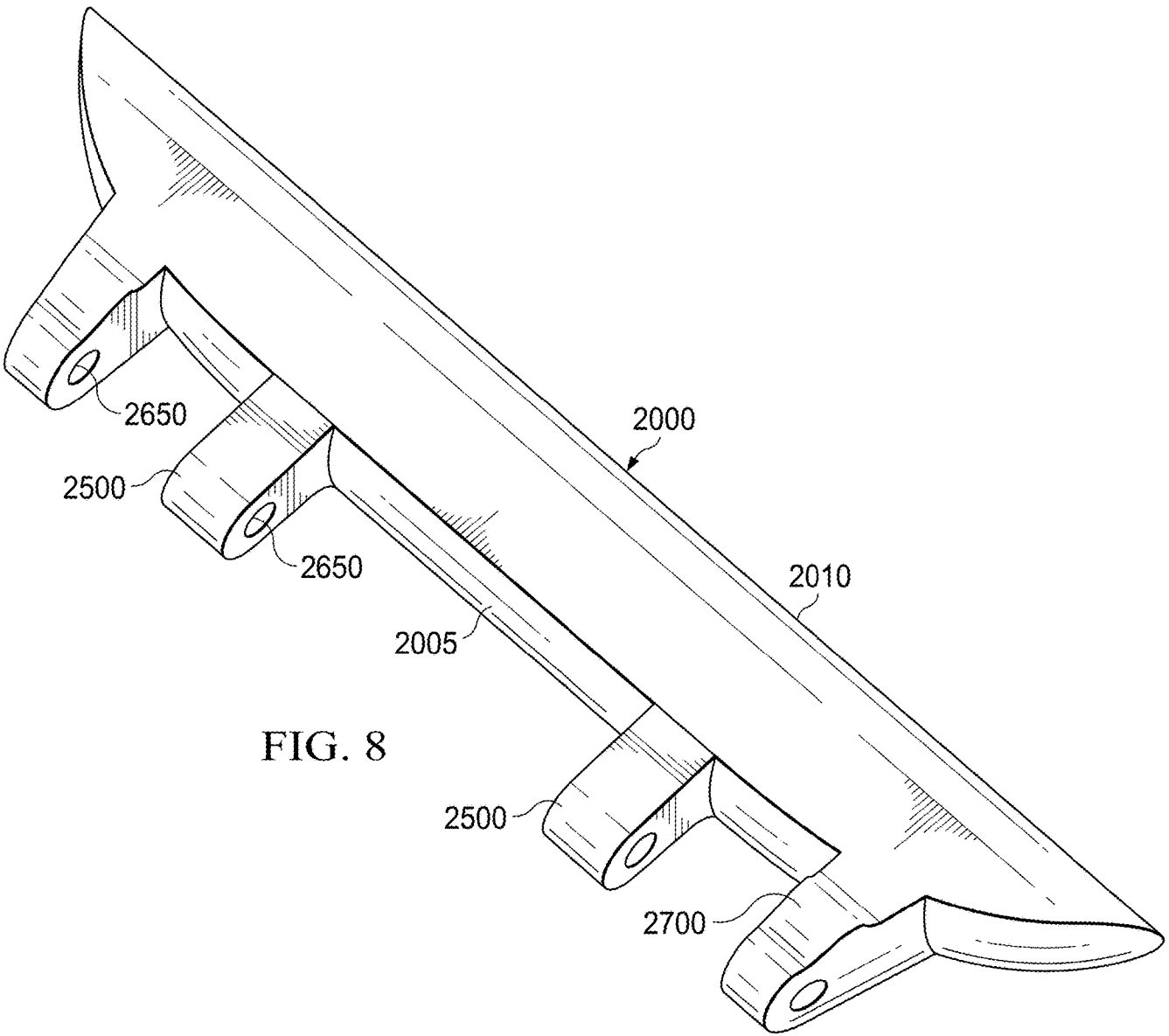
FIG. 8 is a bottom perspective view of the connectors of FIG. 6.

Different connectors 2000 may require different attachment points 1600 to securely attach to the cuff 50. For example, some connectors 2000 may require holes on the attachment surface 1602 of each arm 1500 to accept the studs or prongs 2500 that extend from the rear connector surface 2005 of the connectors 2000, as illustrated in FIGS. 7 and 8. These holes or cavities 1600 formed on the attachment surface 1602 of the arms 1500 may be about 0.05 mm to about 4 mm in depth from the attachment surface 1602. The depth of the holes or cavities allows the studs or prongs 2500 to rotate, minimally, within the attachment points 1600. Because the prongs 2500 are free to rotate minimally within the attachment points 1600 and are not rigidly fastened, lateral breakage of the cuff 50 is prevented when the arms 1500 are separated for a user's wrist. In this exemplary embodiment, protuberances 2700 can be formed on the surface of the studs or prongs 2500. As the arms 1500 are separated laterally and the prongs 2500 rotate within the attachment pints 1600, the protuberances 2700 rotate with the prongs 2500 and engage the bottom and/or rear interior surfaces of the holes or cavities formed in the arms 1500. This engagement between the protuberances 2700 and the bottom and/or rear interior surfaces of the holes or cavities 1600 allows the arms 1500*a*, 1500*b* to be separated to a position where the arms 1500 do not return to their original shape until the protuberances 2700 are disengaged from the bottom and/or rear interior surfaces of the holes or cavities 1600. In some embodiments, the protuberances 2700 are configured to ensure that the arms 1500 maintain a fixed position during, for example, maintenance or display of the cuff 50.

Different connectors 2000 may require different attachment points 1600 to securely attach to the cuff 50. For example, some connectors 2000 may require holes or cavities 160 on the attachment surface 1602 of each arm 1500 to accept the studs or prongs 2500 that extend from the rear connector surface 2005 of the connectors 2000, as illustrated in FIG. 7. These holes or cavities 1600 formed on the attachment surface 1602 of the arms 1500 may be about 0.05 mm to about 4 mm in depth from the attachment surface 1602. The depth of the holes or cavities allows the studs or prongs 2500 to rotate, minimally, within the attachment points 1600. Because the prongs 2500 are free to rotate minimally within the attachment points 1600 and are not rigidly fastened, lateral breakage of the cuff 50 is prevented when the arms 1500 are separated for a user's wrist. In some embodiments, such as the one illustratively shown in FIG. 7, the connectors 2000 can be coupled to the arms 1500 with one or more screws or pins 1700. According to an exemplary embodiment, the connector 2000 may be attached to the attachment points 1600 with an adhesive. In another embodiment, each connector 2000 can define a channel extending transversely through the width of the connector 2000 proximate to the front connector surface 2010. In such embodiments, a fixed pin, a spring-loaded pin, a screw, or any other suitable mechanical structure can be inserted through the channel and into correspondingly configured holes or channels on the body of the watch 1000.

As discussed herein, the connectors 2000 can be coupled to each arm 1500 with a pin 1700. In some embodiments, such as the one shown in FIGS. 7 and 8, a channel 2650 is formed that extends through the width of each stud or prong 2500 of each connector 2000. Another channel 1750 formed in the side of the arm 1500 that extends through the width of the arm 1500. In such embodiments, the channels 2650 of the studs or prongs 2500 of each connector 2000 coaxially align with the channel 1750 of a corresponding arm 1500 when the studs or prongs 2500 of each connector 2000 are inserted into the cavities 1600 (attachment points 1600) of the corresponding arm 1500. The pin 1700 can be inserted through the channels 2650, 1750 to couple the connector 2000 to the arm 1500. According to example implementations of the present general inventive concept, the pin 1700 may have a thickness between about 0.02 mm and about 2 mm, and may have a length equal to or less than the width of the arms 1500. In exemplary embodiments including the pin 1700, such pin 1700 can be formed of a high-strength material such as steel or a similar metal. According to exemplary embodiments of the present general inventive concept, the pin 1700 may be a single component which extends partially or completely across the width of the arm 1500. According to other exemplary embodiments, the pin 1700 may be multiple components, e.g., two pieces which are inserted on either side of the arm 1500 and extend only partially across the width of the arm 1500.

Exemplary embodiments of the present general inventive concept may use a combination of methods, e.g., glue, screws, and/or one or more pins 1700, to attach each connector 2000 to a corresponding attachment point 1600. The attachment points 1600 may be made general-purpose, i.e., formed to accommodate multiple types of connectors 2000, for example by including a plurality of different cavities, protrusions, etc. Alternatively, each attachment point 1600 may be formed to accommodate a specific type of connector 2000.

Figure 9:
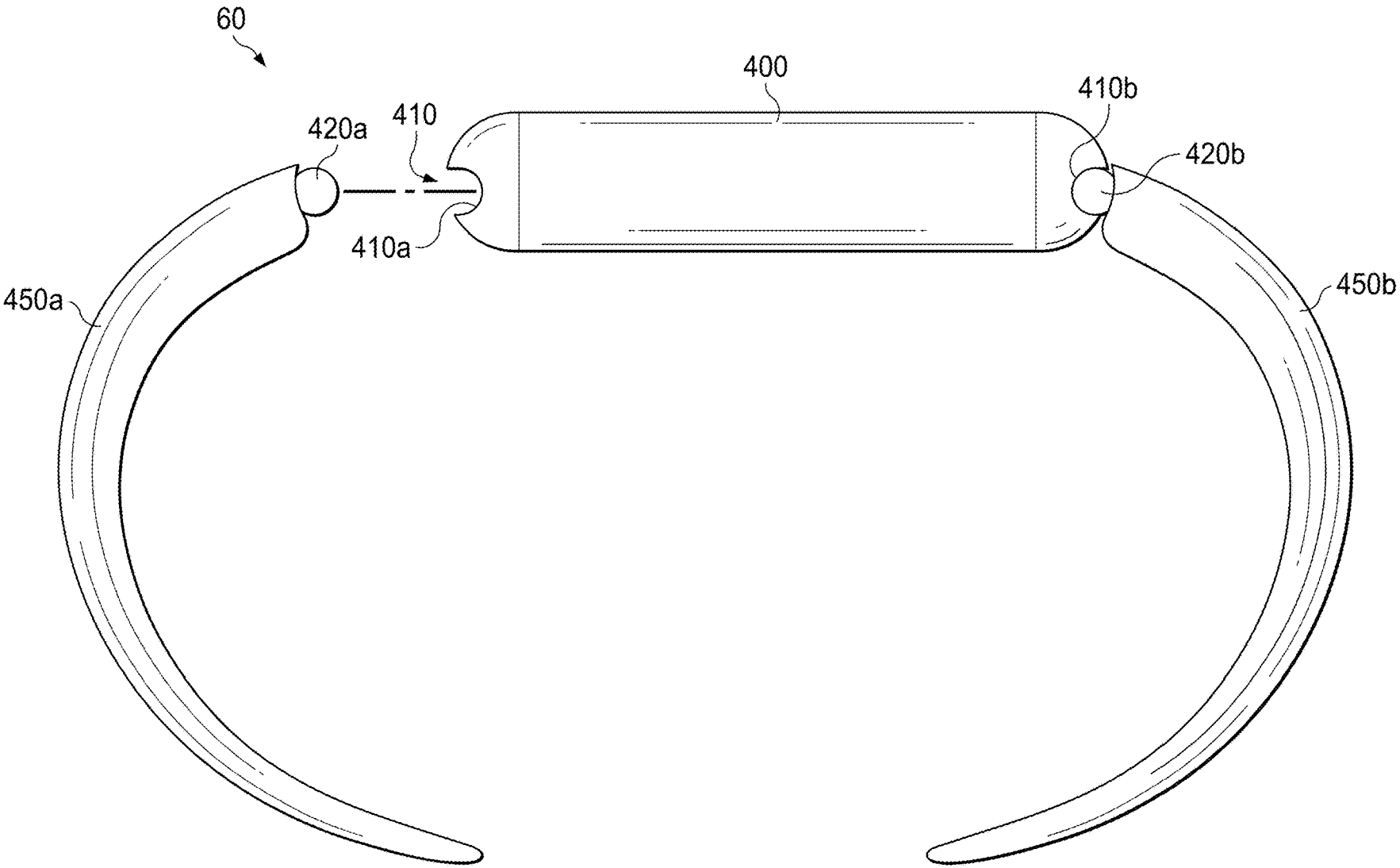
FIG. 9 is a side view of another example implementation of the disclosed cuff, wherein connectors are configured to be attached to sockets on the watch.

Now referring to FIG. 9, a watch 400 may include two opposing sockets 410 (socket 410*a*, socket 410*b*) and two arcuately-shaped arms 450*a*, 450*b*. Each arm 450*a*, 450*b* includes a connector 420*a*, 420*b* configured to attach to a corresponding socket 410*a*, 410*b* on the watch 400. Once the connectors 420*a*, 420*b* are affixed to their respective arm 450*a*, 450*b*, the connectors 420*a*, 420*b* may then be attached to the corresponding sockets 410*a*, 410*b* to secure the arms 450*a*, 450*b* to the watch 400 thereby forming a cuff 60. FIG. 9 illustrates a side view of the cuff 60 with one arm 450*a* separated from the watch 400. The connectors 420*a*, 420*b* may be attached to the sockets 410*a*, 410*b* by any suitable means, e.g., by sliding in and locking in place with tabs, screws, etc. The sockets 410*a*, 410*b* themselves may be any shape or configuration suitable to receive the connectors 420*a*, 420*b*. For example, the sockets 410*a*, 410*b* may be indentations in the watch 400. Alternatively, the sockets 410*a*, 410*b* may include one or more pins or springs to secure components in place, etc. The sockets 410*a*, 410*b* may also be located anywhere on the watch 400 suitable to support a watch band or the cuff 60.

It will be understood that the sizes and shapes of the sockets 410*a* and 410*b* and connectors 420*a*, 420*b* are exaggerated in FIG. 9 for clarity. Other exemplary embodiments of the present general inventive concept may include sockets 410*a*, 410*b* and connectors 420*a*, 420*b* of different sizes and shapes. The location of the sockets 410 may also vary depending on the design of the watch 400 and the connectors 420*a*, 420*b*. Furthermore, the sockets 410 may be visible from the outside when the connectors 420*a*, 420*b* are connected, or the sockets 410 may be formed such that they are invisible from the outside once the connectors 420*a*, 420*b* are attached thereto.

Figure 10:
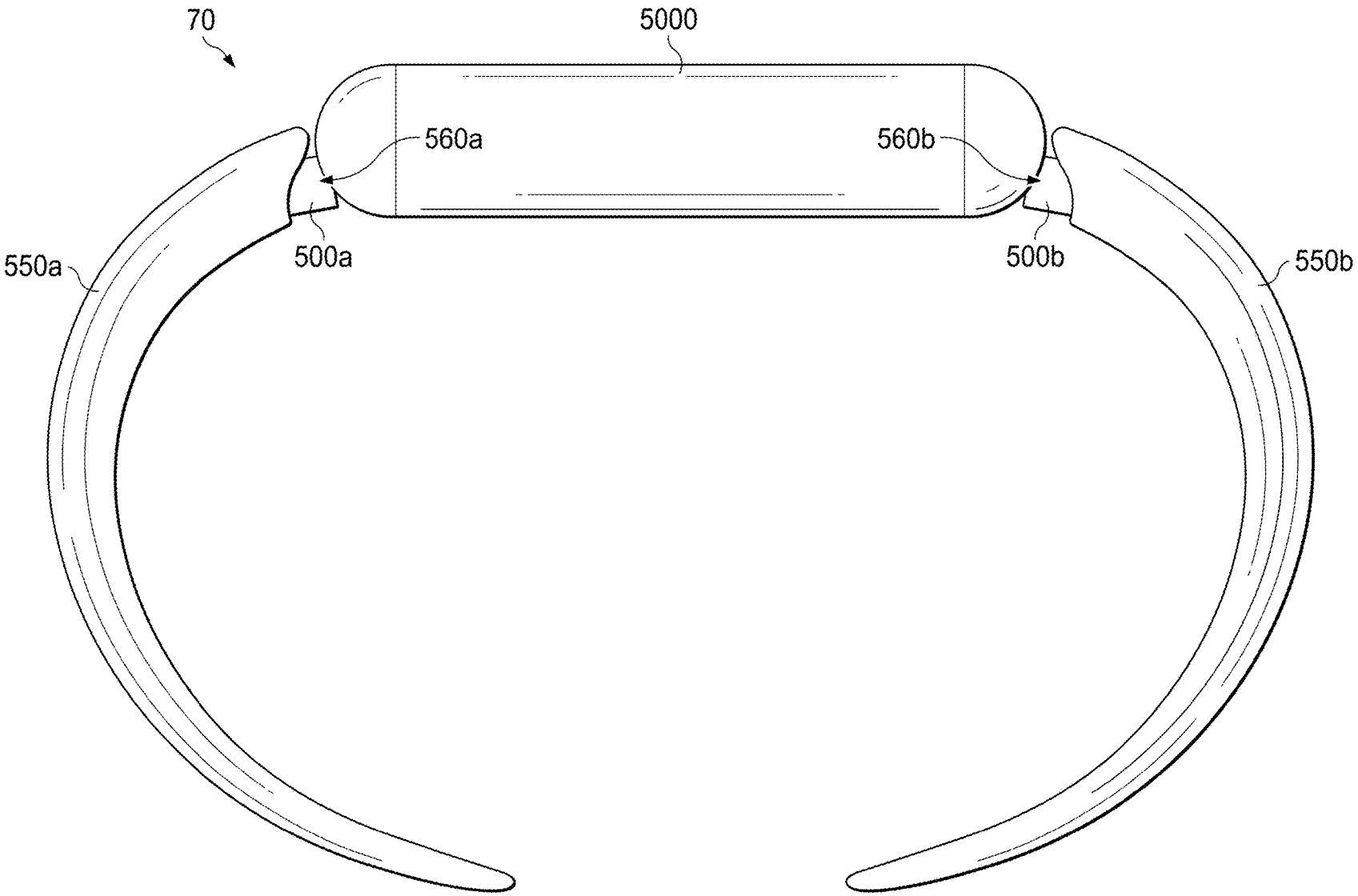
FIG. 10 is a side view of yet another example implementation of the disclosed cuff, wherein connectors are exposed when attached to the watch.

FIG. 10 illustrates a cuff 70 with connectors 500*a*, 500*b* according to another exemplary embodiment. The connectors 500*a*, 500*b* may be exposed when attached to a watch 5000, as illustrated in FIG. 10. The connectors 500*a*, 500*b* may be partially or completely covered by the corresponding arm 550*a*, 550*b* and watch 5000 when attached, such that it is invisible from the outside.

Further referring to FIG. 10, the connectors 500*a*, 500*b* may be integrated with the corresponding attachment points 560*a*, 560*b* during construction, such that the connectors 500*a*, 500*b* are formed as part of the corresponding arm 550*a*, 550*b*. For example, the connectors 500*a*, 500*b* may be included in a mold in which the arms 550*a*, 550*b* are injection-molded so that the attachment points 560*a*, 560*b* are molded around the corresponding connectors 500*a*, 500*b*. Alternatively, the connectors 500*a*, 500*b* may be fabricated as part of the structure of each arm 550*a*, 550*b*, such that the arms 550*a*, 550*b* and the corresponding connectors 500*a*, 500*b* form a single integrated piece.

Figure 11:
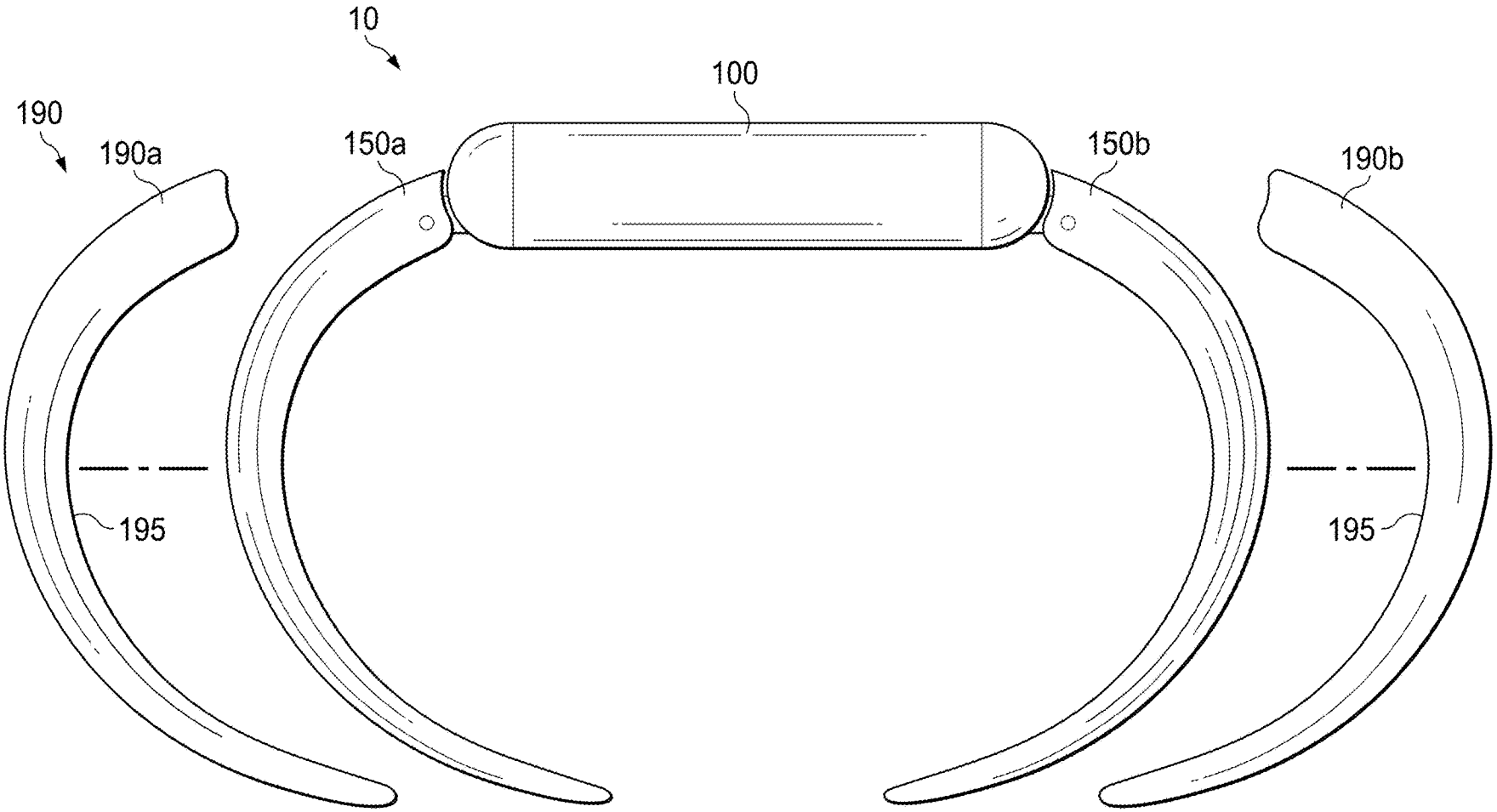
FIG. 11 is a side view of the cuff of FIG. 1 showing coverings placed over the arms.

With reference to FIG. 11, the arms 150 (arm 150*a* and arm 150*b*) may form the inner surface or structure of the cuff 10, i.e., the arms 150 may be worn directly on the user's wrist (or other body part). According to other exemplary embodiments of the present general inventive concept, the arms 150 may instead be covered with a separate removable covering or shell 190 (removable shell 190*a* and removable shell 190*b*) made of, for example, fabric, plastic, leather, or a combination of materials. The removable covering or shell 190 may cover all or part of the arms 150 including inner and outer surfaces thereof, without interfering with the connectors 200 or their ability to connect to the watch 100. The covering 190 may impart a desired physical quality (e.g., color, texture, etc.) to the cuff 10. The covering 190 may also provide a contact surface 195, corresponding to the section of the covering 190 which contacts the user's skin when they put on or wear the cuff 10. The covering 190 may be attached to the arms 150 by any suitable means, including stitching, adhesive, snap-fit, etc. Attaching the covering 190 with adhesive may provide a seamless look to the cuff 10, and may also provide a smooth unbroken contact surface 195 for the user's wrist. FIG. 11 illustrates a covering 190 according to an exemplary embodiment of the present general inventive concept, the arrows indicating that the covering 190 is placed over the arms 150. According to the illustrated exemplary embodiment, the covering 190 may be split into two sections 190*a* and 190*b*, corresponding to arms 150*a* and 150*b*.

According to exemplary embodiments of the present general inventive concept, the covering 190 may be uniform, i.e., all surfaces may be made of the same material. According to other exemplary embodiments, the covering 190 may be a combination of materials, for example leather and plastic. The covering 190 may also include metal, for example metal caps on the ends of the arms 150*a* and 150*b* near the opening 300.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

The invention claimed is:

1. A watch cuff, comprising:

a first connector coupled to a first side of a body of a watch;

a second connector coupled to a second side of the body of the watch opposite the first side;

a first arm having an arcuate profile and formed from a rigid or semi-rigid material, the first arm comprising a first attachment point configured to detachably couple the first arm to the first connector; and a second arm having an arcuate profile and formed from the rigid or semi-rigid material, the second arm comprising a second attachment point configured to detachably couple the second arm to the second connector, wherein the first and second arms cooperate to define an opening opposite the body of the watch when the first and second arms are coupled to the first and second connectors and the first and second connectors are coupled to the first and second sides of the body of the watch, the first arm being displaceable about the first connector between a separated position and an unseparated position, a size of the opening being increased with a displacement of the first arm from the unseparated position to the separated position, the first connector comprises a first prong positioned to be matingly received by the first attachment point, the first prong having a first protuberance configured to, upon displacement of the first arm to the separated position, engage an inner surface of the first attachment point in a manner that retains the first arm in the separated position, the first attachment point further being sized to house the first protuberance when the first arm is in the unseparated position, the first connector further comprises a second prong having a second protuberance, a third prong, and a fourth prong, the third and fourth prongs having shapes that are different than shapes of the first and second prongs, the first arm further comprising a second attachment point that inwardly extends into the first arm, the second attachment point configured to matingly receive the second prong of the first connector, the second protuberance of the second prong configured to, upon displacement of the first arm to the separated position, engage an inner surface of the second attachment point in a manner that further retains the first arm in the separated position, the second attachment point being sized to house the second protuberance when the first arm is in the unseparated position, and wherein the first and second arms are configured to laterally flex outwardly from a pre-flexed shape to allow an object to pass through the opening without breaking.

2. The watch cuff of claim 1, wherein the first and second arms are configured to laterally flex inwardly to return to the pre-flexed shape once the object passes through the opening, securing the watch cuff to the object.

3. The watch cuff of claim 1, wherein:

each of the first arm and the second arm comprises a top surface, a bottom surface, and a connecting surface extending between the top surface and the bottom surface, the connecting surface of each of the first and second arms defining a surface from which the first and second attachment points inwardly extend; and a third prong and a fourth prong of the first connector are positioned between the first and second prongs of the first connector.

4. The watch of claim 1, wherein:

the second arm includes a plurality of attachment points;

the second connector comprises a first prong, a second prong, a third prong, and a fourth prong that are each configured to be matingly received in one of the plurality of attachment points of the second arm, the third and fourth prongs of the second connector having a configuration similar to a configuration of the third and fourth prongs of the first connector; and wherein the first prong and the second prong of the second connector each have a protuberance configured to, upon displacement of the second arm to the separated position, engage an inner surface of attachment point of the plurality of attachment points in which the first and second prongs of the second connector are positioned in a manner that further retains the second arm in the separated position.

5. The watch cuff of claim 1, wherein the first and second arms comprise one or more of thermoplastics, polycarbonates, nylon, elastomeric materials, carbon fiber, steel, precious metals, and semi-precious metals.

6. The watch cuff of claim 1, further comprising a first removable shell configured to encase the first arm and a second removable shell configured to encase the second arm.

7. The watch cuff of claim 6, wherein each of the first and second removable shells comprise one or more of fabric, plastic, metal, and leather.

8. A watch cuff, comprising:

a first connector having a first connecting surface, a second connecting surface opposite the first connecting surface, and a plurality of first prongs extending from the first connecting surface, the second connecting surface detachably coupled to a watch, at least one first prong of the plurality of first prongs has a first protuberance;

a second connector having a third connecting surface, a fourth connecting surface opposite the third connecting surface, and a plurality of second prongs extending from the third connecting surface, the fourth connecting surface detachably coupled to the watch opposite the second connecting surface of the first connector, at least one second prong of the plurality of second prongs has a second protuberance;

a first arm having an arcuate profile, the first arm comprising a first attachment surface defining a plurality of first cavities extending inwardly therefrom, the plurality of first cavities each having a shape and position that corresponds with a shape and position of a mating first prong of the first plurality of prongs extending from the first connecting surface, wherein the plurality of first cavities of the first attachment surface and the first plurality of prongs extending from the first connecting surface cooperate to couple the first connector to the first arm; and a second arm having an arcuate profile, the second arm comprising a second attachment surface defining a plurality of second cavities extending inwardly therefrom, each cavity of the plurality of second cavities having a shape and position that corresponds with a shape and position of a mating second prong of the plurality of second prongs extending from the third connecting surface, wherein the plurality of second cavities of the second attachment surface and the plurality of second prongs extending from the third connecting surface cooperate to couple the second connector to the second arm, wherein the first and second arms cooperate to define an opening opposite the watch when the at least first and second attachment surfaces are coupled to the first and second connectors, and the first and second connectors are coupled to the watch, wherein the first and second arms are configured to laterally flex outward from an initial position to a flexed position to allow an object to pass through the opening, wherein the first protuberance is configured to, when the first arm is in the flexed position, engage an inner surface of a mating first cavity of the plurality of first cavities to retain the first arm in the flexed position, wherein the second protuberance is configured to, when the second arm is in the flexed position, engage an inner surface of a mating second cavity of the plurality of second cavities to retain the second arm in the flexed position, wherein a plurality of the first prongs have a different shape than the at least one first prong, and wherein a plurality of the second prongs have a different shape than the at least one second prong.

9. The watch cuff of claim 8, wherein the plurality of first cavities extend inwardly a distance between about 0.05 mm and about 4.0 mm measured from the first attachment surface; and wherein the plurality of second cavities extend inwardly a distance between about 0.05 mm and about 4.0 mm measured from the second attachment surface.

10. The watch cuff of claim 8, wherein the first arm returns to the initial position upon a disengagement of the first protuberance with the inner surface of the mating first cavity of the plurality of first cavities.

11. The watch cuff of claim 8, wherein:

each of the first and second arms further define an aperture that extends through a width of the first and second arms;

the plurality of first prongs of the first connector and the plurality of second prongs of the second connector each define a hole that coaxially aligns with the respective aperture defined by the first and second arms;

the watch cuff further comprise a first lock and a second lock, the first lock configured to engage the aperture defined by the first arm and the hole defined by the plurality of first prongs of the first connector to secure the first connector to the first arm, and the second lock configured to engage the aperture defined by the second arm and the hole defined by the plurality of second prongs of the second connector to secure the second connector to the second arm.

12. The watch cuff of claim 11, wherein the first and second locks each comprise a screw or pin.

13. The watch cuff of claim 8, wherein the first and second arms comprise one or more of thermoplastics, polycarbonates, nylon, elastomeric materials, carbon fiber, steel, precious metals, and semi-precious metals.

14. The watch cuff of claim 8, further comprising a first removable shell configured to encase the first arm and a second removable shell configured to encase the second arm.

15. The watch cuff of claim 14, wherein each of the first and second removable shells comprise one or more of fabric, plastic, metal, and leather.

* * * * *